US005551105A

United States Patent [19]

Short

[11] Patent Number: 5,551,105

[45] Date of Patent: Sep. 3, 1996

[54] APPARATUS COMBINING OVERBED TABLE, IV STAND, WALKER, AND SEAT

[75] Inventor: J. Gordon Short, Salt Lake City, Utah

[73] Assignee: Brevis Corporation, Salt Lake City, Utah

[21] Appl. No.: 296,758

[22] Filed: Aug. 26, 1994

[51] Int. Cl.[6] ..... A61G 7/08; A47C 13/00

[52] U.S. Cl. ..... 5/87.1; 5/658; 5/507.1; 280/648; 280/250.1; 280/87.05; 297/125

[58] Field of Search ..... 5/81.1, 83.1, 86.1, 5/89.1, 507.1; 108/54.1, 144, 11, 5, 108, 107, 110; 297/125, 127; 280/47.38, 47.4, 250.1, 30, 648, 650, 87.05; 248/124, 125

[56] References Cited

U.S. PATENT DOCUMENTS

| | | | |
|---|---|---|---|
| 575,711 | 1/1897 | Haley | 5/507.1 |
| 2,579,704 | 12/1951 | Saul, Jr. | 108/110 |
| 3,194,403 | 7/1965 | Van Horn, Jr. | 248/122 |
| 3,413,663 | 12/1968 | Swann | 280/648 |
| 4,189,123 | 2/1980 | Johnson | 108/108 |
| 4,832,294 | 5/1989 | Eidem | 248/125 |
| 4,997,200 | 3/1991 | Earls | 280/648 |
| 5,000,407 | 3/1991 | Juji et al. | 248/125 |
| 5,135,191 | 8/1992 | Schmuhl | 5/658 |
| 5,224,721 | 7/1993 | Santmann | 280/87.05 |
| 5,337,992 | 8/1994 | Pryor et al. | 5/507.1 |
| 5,364,120 | 11/1994 | Shimansky | 280/650 |
| 5,411,044 | 5/1995 | Andolfi | 5/860.1 |

FOREIGN PATENT DOCUMENTS

| | | | |
|---|---|---|---|
| 2344248 | 10/1977 | France | 5/507.1 |
| 1429479 | 11/1969 | Germany | 5/507.1 |
| 2818189 | 6/1979 | Germany | 5/507.1 |
| 2815763 | 10/1979 | Germany | 5/507.1 |

*Primary Examiner*—Steven N. Meyers
*Assistant Examiner*—Tuyet-Phuong Q. Pham
*Attorney, Agent, or Firm*—Thorpe North & Western

[57] ABSTRACT

An apparatus combining an overbed table, IV stand, walker, and optionally a wheeled chair is described. The IV stand portion of the apparatus can be raised for administering intravenous liquids or lowered for concealment. The table portion can be detachable so that the stand can be attached to a patient's bed. The apparatus contains a wide wheelbase for stability as a walker, yet furnishes easy maneuverability. The apparatus also contains mechanisms for attaching oxygen bottles, catheterization equipment, infusion pumps, and the like. An embodiment containing a wheeled chair functionality combines the table and wheeled chair functionalities so that one or the other can be selected for use. This multifunctional apparatus reduces the amount of occupied floor space in a patient's room and reduces the need for storage space for IV stands, walkers, wheeled chairs and the like.

19 Claims, 9 Drawing Sheets

APPARATUS COMBINING OVERBED TABLE, IV STAND, WALKER, AND SEAT

BACKGROUND OF THE INVENTION

This invention relates to an overbed table. More particularly, the invention relates to an apparatus combining an overbed table, an IV stand for supporting containers of an intravenously administered liquid and the like, a walker for supporting an ambulatory patient, and optionally, a wheeled chair.

Overbed tables are used in hospitals, nursing facilities, and homes to provide a substantially horizontal eating and working surface for patients while they are in bed. Generally, an overbed table is positioned adjacent to each patient's bed. Overbed tables designed for such use generally consist essentially of a horizontal wheeled base support which is adapted to project beneath a bed frame, a vertical standard that rises from one end of the wheeled base, and a horizontal table portion that extends horizontally from the vertical standard and overlies the base portion so that when the base portion is projected beneath a bed frame, the horizontal table portion overlies the bed frame. The horizontal table portion of the overbed table is often adjustable to a height above the bed to accommodate a particular patient's circumstances. The wheels attached to the base portion of the overbed table provide a mechanism for easily moving the table into position for use or away from the bed when not needed.

A patient's condition may require that nourishment, vitamins, medications, blood plasma, liquids, and the like be administered intravenously. To enable delivery of such liquids by gravity flow, a container of the liquid is usually supported by an IV stand that is stored elsewhere and only brought to the room as needed. Attachments are also often used, such as for attaching an oxygen bottle, catheterization equipment, infusion pump, and the like.

Patients often continue to receive intravenous administration of medicinal or nutritional liquids even though they are ambulatory. Some intravenous administration extends over long periods of time and may even continue around the clock. At the same time, ambulatory patients are encouraged to exercise. The benefits of making hospital patients ambulatory as soon as possible include a shorter post-operative recovery and shorter hospital stay. However, due to the limitations of existing equipment, it is impracticable for many patients to move freely about. For example, patients who are unsteady on their feet may not be able to use existing walkers because of imbalance that occurs when lifting and moving the walker frame. Similarly, patients receiving intravenous administration of liquids need a stand that can be safely moved without the danger of upsetting the stand or causing the patient to trip and fall. Present stands commonly have a relatively narrow base making the possibility of upset especially great if the wheels encounter an obstruction or are pushed along a carpet. For the same reason, if a patient stumbles slightly and exerts extra force on the stand, the stand may fall. Even if the stand does not fall, the patient will not be able to lean against the tipping stand for the additional support that would permit recovery of balance. Thus, for many otherwise ambulatory patients, there is no prudent way for them to move about alone. Nevertheless, even if existing walkers are safe for a particular patient, the problems persist of storing such walkers when they are not needed and of keeping such walkers in a patient's room, and thus adding to the floor space occupied by furnishings and equipment.

Wheeled chairs suffer from some of the same problems as IV stands. They are stored in a remote location and can be difficult to locate when required. Some patients can be mobile in a wheeled chair, yet be receiving an intravenously administered liquid. Thus, there is the need for a wheeled chair having a mechanism for hanging a container of such a liquid. Existing wheeled chair designs typically have separate poles that can be attached to the chair. As separate pieces of equipment, however, these poles tend to become separated from the wheeled chair and are unavailable when needed.

In view of the foregoing, it will be appreciated that providing an apparatus combining an overbed table, an IV stand for supporting containers of intravenous liquids, a walker for supporting an ambulatory patient, and optionally a wheeled chair would be a significant advancement in the art.

OBJECTS AND SUMMARY OF THE INVENTION

It is an object of the present invention to provide an apparatus combining an overbed table for furnishing a substantially horizontal eating and working surface for patients while they are in bed, an IV stand for hanging intravenously administered liquids, a walker for supporting an ambulatory patient, and optionally, a wheeled chair.

It is also an object of the invention to provide multifunctional medical equipment that requires less floor space than is needed for separate pieces of equipment each having a single function.

It is another object of the invention to provide a walker for supporting an ambulatory patient that also furnishes a mechanism for supporting a container of intravenously administered liquid, oxygen bottle, catheterization equipment, and the like.

It is a further object of the invention to provide an overbed table apparatus combining a table and chair unit such that pivoting the unit in one position provides a substantially horizontal table surface and pivoting the unit to another position provides a chair.

It is yet another object of the invention to provide an apparatus comprising an IV stand for hanging a plurality of containers of intravenously administered liquids, wherein such containers can be hung in a generally horizontal linear arrangement to facilitate tracing tubing from such containers to the patient and to reduce the likelihood of tangling such tubing.

These and other objects are achieved by providing an apparatus combining an overbed table, an IV stand, and a walker comprising a wheeled base adapted to project beneath a bed frame and having a wide wheelbase for providing maneuverability and stability; a table for providing a generally horizontal work surface adapted to overlie the bed frame when the wheeled base projects therebeneath; a generally vertical standard disposed on the base including a table attachment mechanism for attaching the table thereto; a handle mechanism disposed on the standard for gripping by an ambulatory user of the apparatus for pushing and steering of the apparatus and for supporting the ambulatory user; and an IV stand mechanism for supporting at least one container of intravenously administered liquid. In one embodiment of the invention, the table is detachable and comprises a generally planar surface with or without raised edges. With the table detached, the apparatus can be attached to a hospital bed so that when the bed is moved, the apparatus including the IV stand moves with it. The IV stand mechanism is divided into an upper member and a lower member. The upper member includes hooks for supporting containers of intravenously administered liquid and can be raised to enhance gravity flow of the liquid. The upper and lower members are adapted to fit together to conceal the hooks when not in use. The apparatus further contains mechanisms for attaching an oxygen bottle, catheterization equipment, infusion pump, and the like.

In another embodiment, apparatus combining an overbed table, an IV stand, a walker, and a wheeled chair comprises a wheeled base adapted to project beneath a bed frame and having a wide wheelbase for providing maneuverability and stability; table means for providing a generally horizontal work surface adapted to overlie the bed frame when said wheeled base projects therebeneath; a generally vertical standard disposed on the base including means for pivotally attaching the table means and means for adjusting the height of the table means; handle means disposed on the standard for gripping and pushing the apparatus; IV stand means disposed on the standard for supporting at least one intravenously administered liquid container; and chair means disposed on the standard. The chair means is joined to the reverse side of the table means such that when the table means is disposed in a generally horizontal orientation the chair means is unavailable for seating an individual and when the table means is disposed in a generally vertical orientation the chair means is disposed for use. Locking means is provided for locking the table means and chair means in selected orientations.

DETAILED DESCRIPTION OF THE INVENTION

Figure 1:
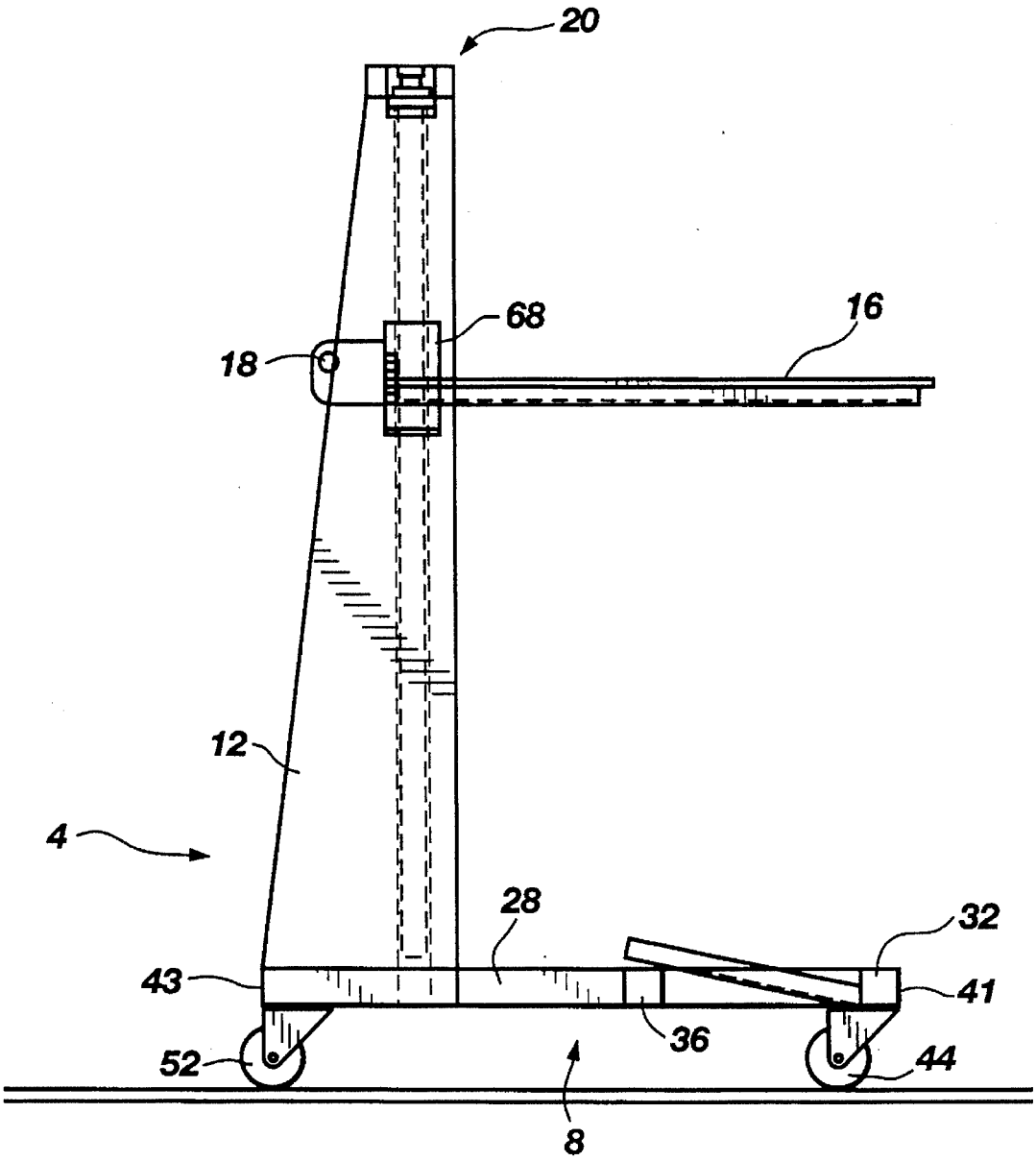
FIG. 1 shows a side elevational view of an illustrative embodiment of the apparatus of the present invention.
Figure 2:
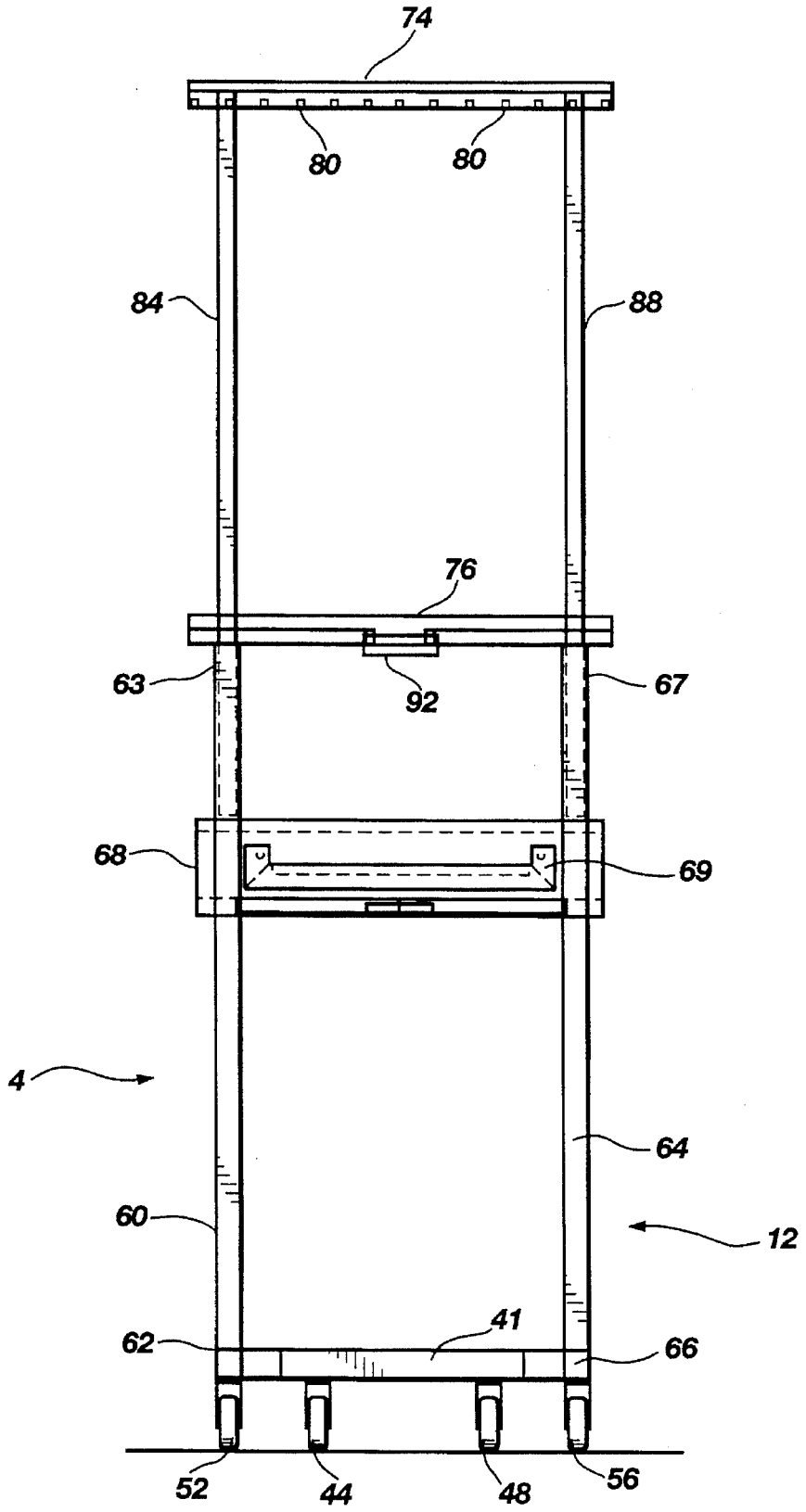
FIG. 2 shows a front elevational view of the apparatus of FIG. 1 with the upper member of the IV stand means in a raised position.

Before the present apparatus combining an overbed table, an IV stand for attaching intravenously administered liquid containers, a walker for supporting an ambulatory patient, and, optionally, a wheeled chair for transporting a patient is disclosed and described, it is to be understood that this invention is not limited to the embodiments and materials disclosed herein as such embodiments and materials are merely illustrative. It is also to be understood that the terminology used herein is used for the purpose of describing particular embodiments only and is not intended to be limiting since the scope of the present invention will be limited only by the appended claims and equivalents thereof.

In describing and claiming the present invention, the following terminology will be used in accordance with the definitions set out below.

As used herein, an "intravenously administered liquid" is any liquid that can be administered intravenously to a patient, such as nourishment, vitamins, medications, whole blood, blood plasma, liquids, and the like.

As used herein, an "IV stand" is a stand for supporting or hanging a container of an intravenously administered liquid.

As used herein, "work surface" means the surface provided by the table portion of an overbed table and adapted to be used for supporting tableware, writing materials, reading materials, and other similar items in a patient's room.

Referring to FIGS. 1–6, there is shown an illustrative embodiment of an apparatus 4 functionally combining an overbed table, an IV stand for attaching a container of intravenously administered liquid and the like, and a walker for supporting an ambulatory patient according to the present invention. The apparatus 4 contains a base portion 8, a generally vertical standard 12 coupled to and extending upwardly from the base 8, table means 16 coupled to and extending generally horizontally from the standard 12 so that the table means 16 is in parallel alignment with and generally overlies the base 8, handle means 18 coupled to the standard 12 for supporting an ambulatory patient, and IV stand means 20 coupled to the standard 12 for attaching one or more containers of intravenously administered liquid.

The base 8 includes generally horizontal, forwardly extending elongate side members 24 and 28 joined by front and back cross members 32 and 40 and an optional intermediate cross support member 36. The side members 24 and 28 may angle inwardly toward the longitudinal axis 42 of the base 8 so that the front 41 of the base 8 is narrower than the rear 43 of the base 8. Swiveling wheels 44, 48, 52, and 56 are coupled to the base 8 where the side members 24 and 28 intersect the front cross member 32 and back cross member 40, respectively. These wheels provide a wide wheelbase for stability and also enable easy maneuverability of the apparatus 4. The base 8 is adapted to project beneath the patient's bed, as in standard overbed tables known in the art. If desired, side members 24 and 28 can be generally parallel and end members 32 and 40 can be of essentially the same length forming a generally rectangular base 8. Other adaptations of the base are also considered within the scope of the invention.

Figure 4:
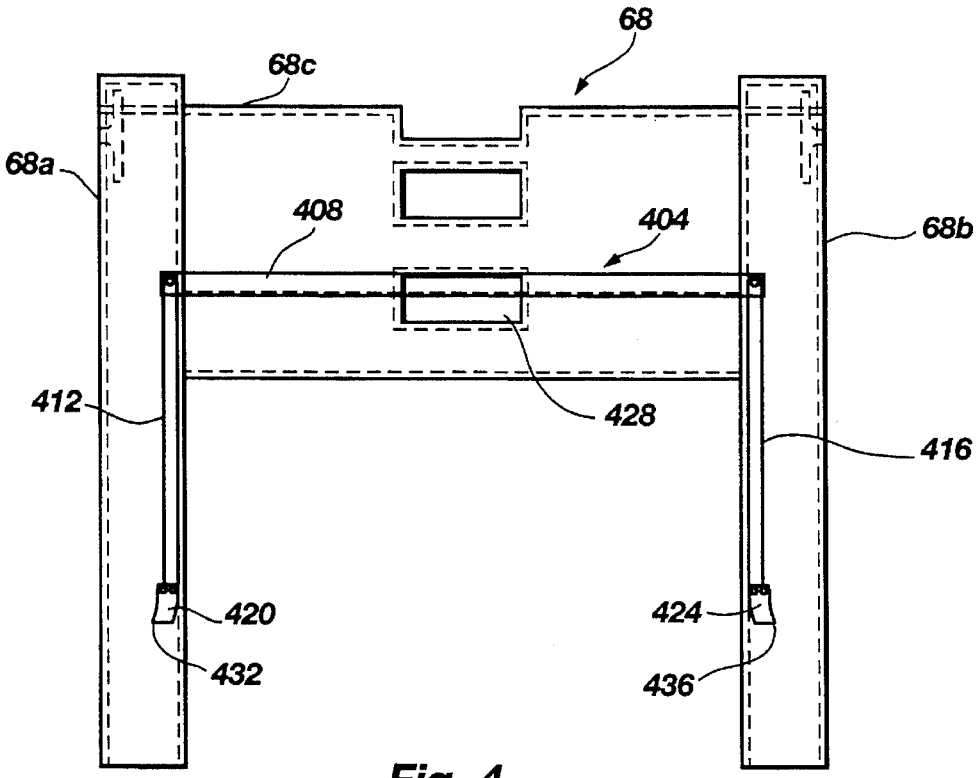
FIG. 4 shows a back elevational view of an illustrative embodiment of table attachment means according to the present invention.
Figure 11:
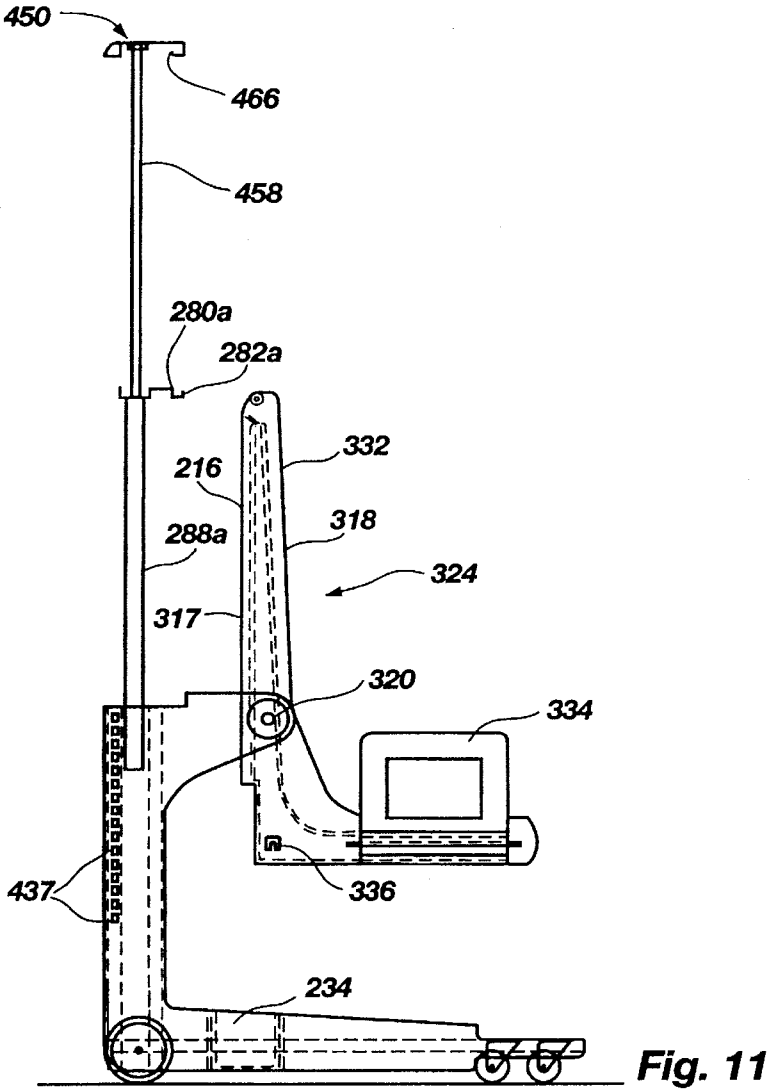
FIG. 11 shows a side elevational view of an illustrative embodiment of the apparatus including chair means with the chair means in an operable position and auxiliary IV support means in a raised position.
Figure 10:
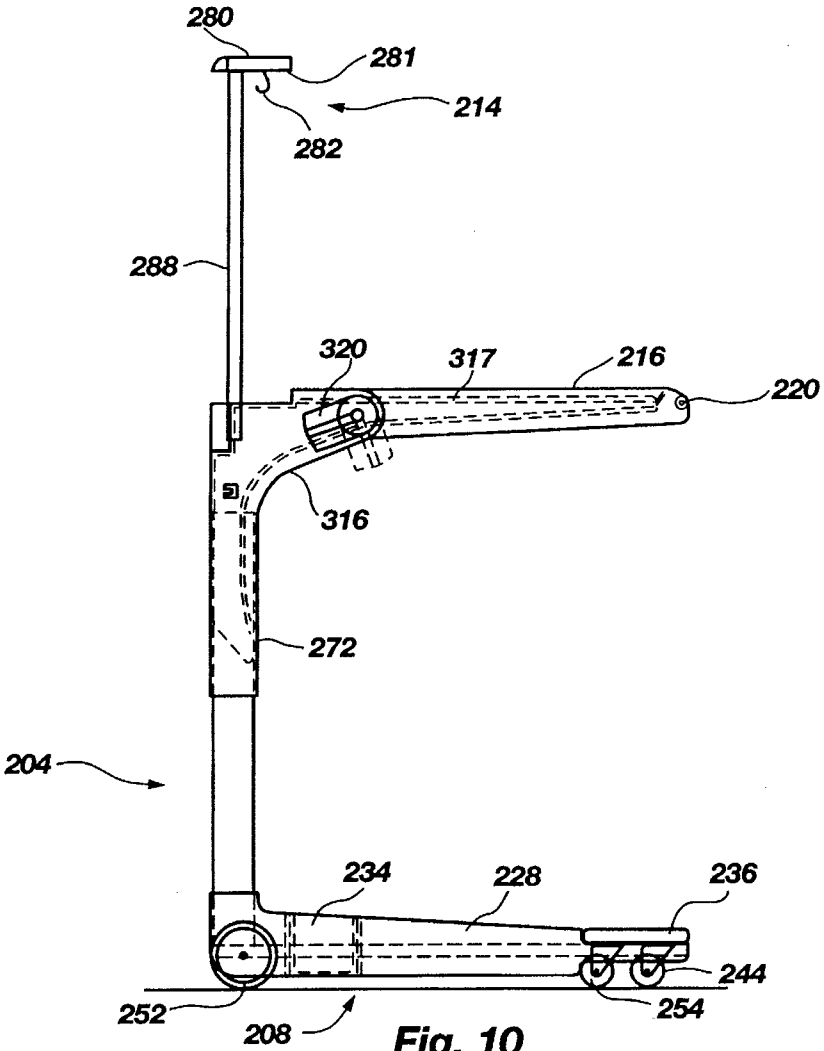
FIG. 10 shows a side elevational view of the apparatus of FIG. 7 with the IV stand means in the raised position.

The standard 12 comprises a pair of spaced-apart, vertically aligned hollow upright support members 60 and 64 coupled at their lower ends 62 and 66 to the back end 43 of base 8. A table attachment means 68 is slidably disposed on the support members 60 and 64 near their upper ends 63 and 67. The table attachment means 68 comprises a pair of elongate tubular members 68*a* and 68*b* (best seen in the illustrative embodiment shown in FIG. 4) slidably disposed on support members 60 and 64. A table support member 68*c* interconnects the tubular members 68*a* and 68*b*. The table attachment means 68 also contains a mechanism, which will be described in more detail below, for detachably joining the table means 16 to the table attachment means. The height of the table attachment means 68 can be adjusted for the convenience of the patient by securing the table attachment means 68 to support members 60 and 64 at a selected height by securing means. The securing means can be any mechanism known in the art for releasably securing the table attachment means 68 to support members 60 and 64, such as a ratchet mechanism, pins, or cams. An illustrative example of such securing means is shown in FIG. 4, wherein the securing means 404 comprises a grip bar 408, two generally vertical connector bars 412 and 416 disposed on the grip bar 408, and two stop links 420 and 424 respectively disposed on the connector bars 412 and 416. The grip bar 408 is a generally horizontally disposed elongate bar that can be mounted on the exterior or the interior of the table attachment means 68. The embodiment shown in FIG. 4 has the grip bar 408 mounted interiorly, with an opening 428 provided in the table attachment means 68 for access to the grip bar 408. Connector bars 412 and 416 are also elongate bars, and are disposed in a generally vertical orientation so that the upper ends of the connector bars 412 and 416 are coupled to the grip bar 408 and the lower ends of the connector bars 412 and 416 are pivotally joined to the stop links 420 and 424. Each stop link 420 and 424 contains a projecting portion 432 and 436 that is designed to be received in openings 437 adapted therefor spaced at intervals along the vertical length of support members 260 and 264 (FIG. 11). The securing means 404 holds the table attachment means 68 at a selected height on the support members 60 and 64 when the projecting portions 432 and 436 of the stop links 420 and 424 are received in the openings in the support members 60 and 64, thus preventing the table attachment means 68 from sliding on the support members 60 and 64. The projecting portions 432 and 436 are held in place in the openings in the support members either by the weight of the grip bar 408 and connector bars 412 and 416 causing the stop links 420 and 424 to pivot against the support members 60 and 64 and/or by biasing means such as springs. The height of the table attachment means 68 can be adjusted by gripping and lifting upward on the grip bar 408 which lifts the connector bars 412 and 416 and the stop links 420 and 424, thus pulling the projecting portions 432 and 436 out of the openings 437 in the support members 60 and 64. The table attachment means 68 can then slide along the support members 60 and 64 to a selected height, whereupon releasing the upward pressure on the grip bar 408 permits the projecting portions 432 and 436 to again be received in the openings 437 in the support members 60 and 64 to thus secure the table attachment means 68 at the selected height.

Table means 16 is detachably joined to the table attachment means 68 so that the table means 16 can be used to provide a work surface or can be removed for cleaning or when the table means 16 is not needed. When the base 8 projects beneath the bed frame, the table means 16 overlies the bed frame. The table means 16 can have an upwardly extending edge or rim around the circumference thereof, forming a tray, to prevent items from sliding therefrom, or can be a substantially planar table lacking such an edge or rim. Trays are often conveniently used for eating purposes because the edge or rim inhibits items from being accidentally knocked from the tray. Tables are conveniently used for other activities, including as a support for writing, holding reading materials, and so forth.

Figure 5:
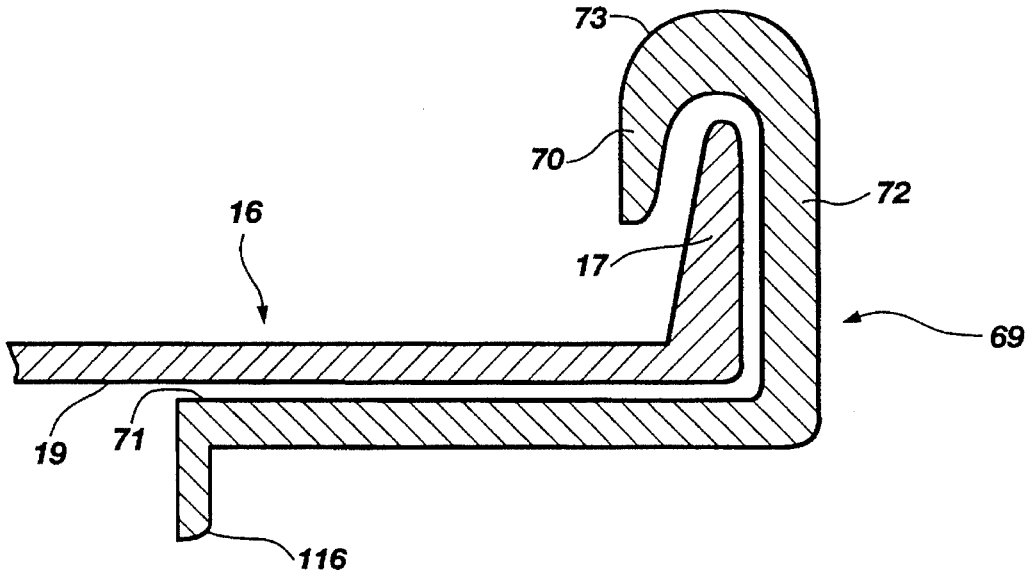
FIG. 5 shows a side sectional view of a bracket for detachably coupling table means to the apparatus of FIG. 1.
Figure 6:
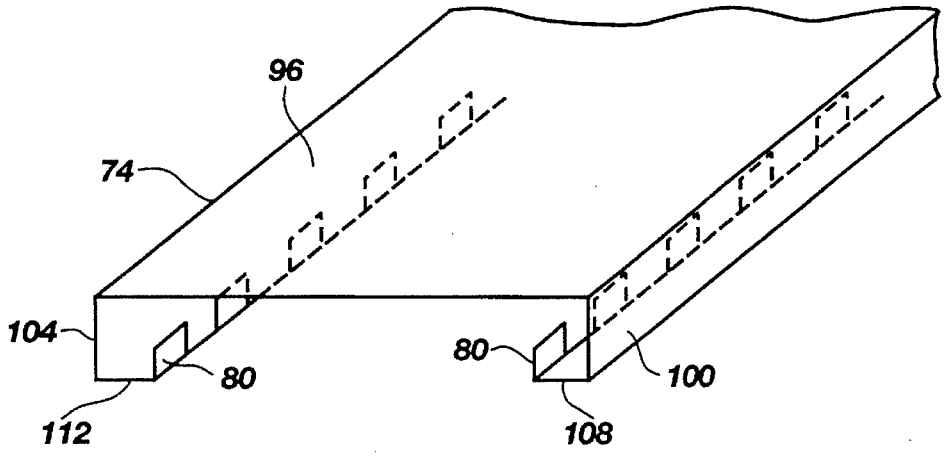
FIG. 6 shows a perspective view of the upper member of the IV stand means of the apparatus of FIG. 1.
Figure 8:
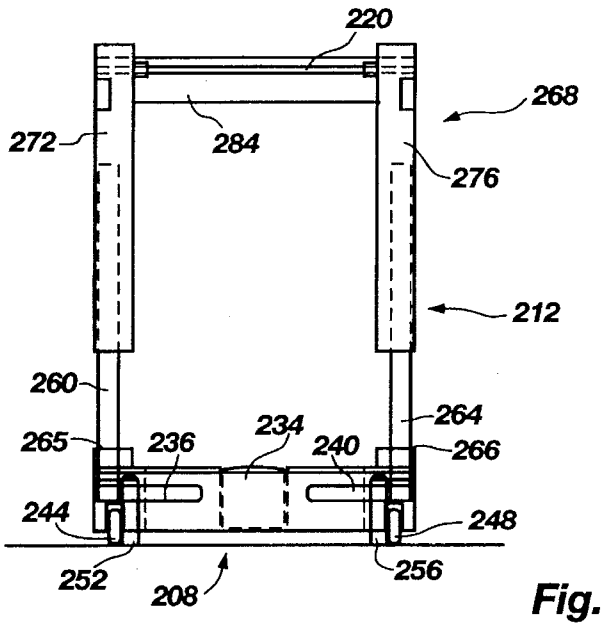
FIG. 8 shows a front elevational, partial view of the apparatus of FIG. 7.
Figure 9:
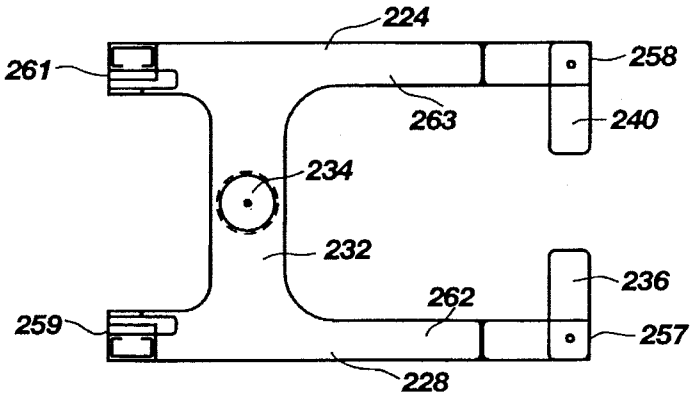
FIG. 9 shows a top, partial view of the apparatus of FIG. 7.
Figure 7:
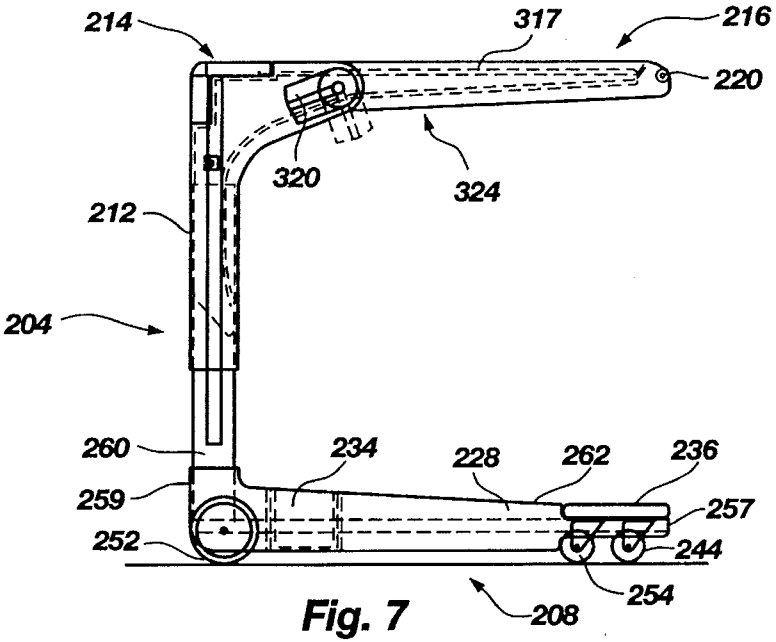
FIG. 7 shows a side elevational view of an illustrative embodiment of the apparatus of the present invention including chair means, with the table means in an operable position.

An illustrative embodiment of a mechanism that permits detachable joining of the table means 16 to the table attachment means 68 is shown in FIG. 5, wherein a portion of the table attachment means 68 comprises a bracket 69 comprising a downwardly extending lip 70 and a generally horizontal table support surface 71 joined by a C-shaped member 72 that encloses a hollow or void 73 that is adapted to receive an upwardly extending edge 17 of the table means 16. The table means 16 is coupled to the bracket 69 by tilting the table means 16 and inserting the upwardly extending edge 17 of the table means under the lip 70 so that the edge 17 fits into and is held in the hollow 73 and the bottom surface 19 of the table means 16 rests on the table support surface 71. The table means 16 is detached from the bracket 69 by tilting the table means 16, sliding the edge 17 under the lip 70, and pulling the table means 16 away from the bracket 69. When coupled to the table attachment means 68, the table means 16 extends substantially horizontally and overlies the base 8 in substantial parallel alignment.

Figure 3:
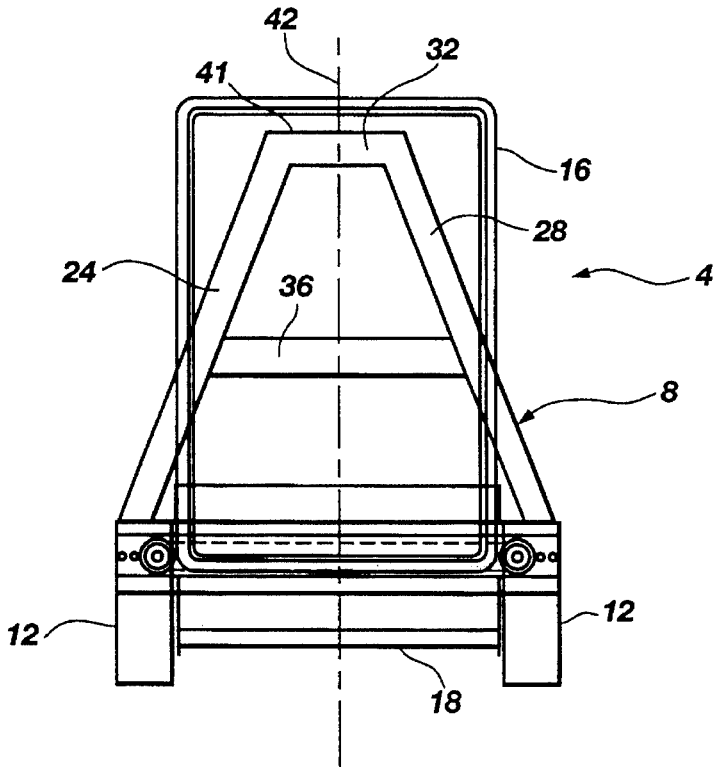
FIG. 3 shows a top view of the apparatus of FIG. 1.

The handle means 18, best seen in FIGS. 1 and 3, is a generally horizontally disposed elongate member attached at each end to the standard 12. The handle means is adapted to be grasped by a person for pushing or pulling the apparatus 4 to a new location. An ambulatory patient can use the apparatus 4 as a walker by standing at the rear of the apparatus 4, grasping the handle means 18, and then walking while leaning on the apparatus 4 as needed for support. The wide wheelbase provides stability so that the apparatus 4 is not easily tipped over. Further, the wheels provide easy maneuverability.

The IV stand means 20 comprises a substantially horizontally disposed elongate member joined to the upper ends 63 and 67 of the support members 60 and 64 and adapted to contain the IV stand functionality for supporting containers of intravenously administered liquids. The IV stand means 20 includes an upper member 74 disposed on a pair of slidable supports 84 and 88 comprising elongate members that are slidably disposed in the hollow portions of the upright support members 60 and 64 of the standard 12. Thus, by grasping the upper member 74 and pulling upwardly, the slidable supports 84 and 88 slide in the hollow portions of their respective upright support members 60 and 64, and the upper member 74 can be raised to a selected height. A locking means 92 is used to lock the upper member 74 at the selected height. This locking means can also be any locking means known in the art, such as ratchets, pins, cams, or an arrangement such as is illustrated in FIG. 4. The height of the upper member 74 can be raised or lowered by releasing the locking means 92, sliding the upper member 74 to a new selected height, and engaging the locking means 92 to secure the upper member 74 at the new selected height.

The upper member 74 is adapted for supporting containers of intravenously administered liquids by containing a plurality of IV attachment means 80 to which containers of intravenously administered liquids can be attached. In the illustrative embodiment shown in FIG. 6, the upper member 74 comprises a top surface 96 and side surfaces 100 and 104. The bottom edges 108 and 112 of the side surfaces 100 and 104 project inwardly and upwardly to form J-like structures that comprise the IV attachment means 80. These IV attachment means 80 are linearly arrayed in a substantially horizontal arrangement. Containers of intravenously administered liquids ordinarily have a ring that can be placed over an individual IV attachment means 80 in the manner of a "hook-and-eye." By placing the ring over the IV attachment means 80, the container can be hung to permit gravity flow of the liquid to the patient. The upper member 74 is adapted to be joinable to a horizontal support member 76 to conceal the IV attachment means 80 when the upper member 74 is lowered to its lowest position. The linear arrangement of IV attachment means 80 is advantageous in situations where a patient is receiving a plurality of intravenously administered liquids by making it easier to trace tubing from containers to the patient and to keep the tubing from becoming tangled.

The apparatus 4 is also adapted for attachment of other types of medical equipment such as oxygen bottles, catheterization equipment, infusion pumps, and the like. These pieces of equipment, collectively referred to hereinafter as fluid delivery devices, when appropriate, can be attached to the IV attachment means 80 of the upper member 74 by standard methods such as clamps. Equipment can also be attached to the slidable supports 84 and 88 or the upright support members 60 and 64 in the conventional manner.

The apparatus 4 is also adapted to be attachable to a hospital bed. The need for such a feature arises, for example, when a patient receiving an intravenously administered liquid is transported in bed. It is inconvenient to move the bed and also have to independently move the apparatus 4 being used for supporting the container of intravenously administered liquid. By attaching the apparatus 4 to the bed, the apparatus 4 functionally becomes part of the bed so that by moving the bed the apparatus is also moved. The apparatus is attached to the bed by removing the table means 16 from the apparatus as described above. The apparatus is then joined to the bed by raising the table attachment 68 means to a position above the bed frame, side rails, or head board and then lowering the table attachment means 68 so that a downwardly extending tab 116 on the bracket 69 of the table attachment means 68 fits over the bed frame, side rails, or head board. The table attachment means 68 is then secured at that height by the securing means.

Another illustrative embodiment of the invention is shown in FIGS. 7–14. In this embodiment, the apparatus 204 functionally incorporates the overbed table, IV stand, and walker of the embodiment described above, while also containing a wheeled chair functionality. The apparatus 204 contains a base portion 208, a generally vertical standard 212 coupled to and extending upwardly from the base 208, table means 216 coupled to and extending from the standard 212, handle means 220 coupled to the table means 216 for being grasped, and IV stand means 214 coupled to the standard 212 for attaching one or more containers of intravenously administered liquid.

The base 208 includes generally horizontal, forwardly extending elongate side members 224 and 228 joined by cross member 232. The side members 224 and 228 are generally parallel to each other, however nonparallel arrangements could also be used and are considered within the scope of the invention. The cross member 232 contains a hollow receptacle 234 for holding an oxygen bottle or the like. Swiveling wheels 244 and 248 are coupled to the base 208 at the front ends 257 and 258 of the side members 224 and 228. Non-swiveling wheels 252 ad 256 are coupled to the base 208 at the back ends 259 and 261 of the side members 224 and 228. These wheels provide a wide wheelbase for stability and also enable easy maneuverability of the apparatus 204. An extra pair of wheels 254 and 258 is provided behind the front wheels 244 and 248 for extra stability and to prevent the wheels from catching in the space between the floor of an elevator and the floor of a hall. Pivotally attached near the front of the upper surface 262 and 263 of each side member 224 and 228 is a foot rest 236 and 240 that can be used for supporting the feet of a user of the wheeled chair functionality of the apparatus 204. The foot rests 236 and 240 can pivot to substantially overlie their respective side members 224 and 228 for storage, or can pivot to a position approximately perpendicular to the side members 224 and 228 for use. The base 208 is adapted to project beneath the patient's bed, as in standard overbed tables known in the art.

The standard 212 comprises a pair of upright support members 260 and 264 coupled to the base 208 at their lower ends 265 and 266. Each support member 260 and 264 comprises an elongate member containing a hollow channel. Slidably disposed on these support members 260 and 264 is a support frame 268, illustratively shown in FIG. 8, comprising two slide members 272 and 276 interconnected by a bridging member 284. Each slide member 272 and 276 comprises an elongate member containing a hollow channel. The hollow channel of each slide member 272 and 276 has a support member 260 and 264 slidably disposed therein. The height of the support frame 268 can be selected by sliding the support frame 268 upon the support members 260 and 264. Securing means known in the art, such as pins, cams, ratchets, and the mechanism shown in FIG. 4 can be used to secure the position of the support frame 268 at the selected height.

The IV stand means 214 contains the IV stand functionality for supporting containers of intravenously administered liquids. The IV stand means 214 comprises a generally horizontally disposed elongate member 280 disposed on a pair of slidable supports 288 and 292. These slidable supports 288 and 292 comprise elongate members that are slidably and generally vertically disposed in the hollow channels of the slide members 272 and 276 of the support frame 268, and may also extend into the hollow channels of the support members 260 and 264. Thus, by grasping the horizontal member 280 the slidable supports 288 and 292 slide in their respective hollow channels in the slide members 272 and 276, and the horizontal member 280 can be raised or lowered to a selected height. A locking means 294 is used to lock the horizontal member 280 at the selected height. This locking means can also be any locking means known in the art, such as ratchets, pins, cams, or the mechanism illustrated in FIG. 4. The height of the horizontal member 280 can be raised or lowered by releasing the locking means 294, sliding the horizontal member 280 to a new selected height, and engaging the locking means 294. The horizontal member 280 comprises a lower surface 281 to which is attached a plurality of hooks 282 in a linear array for hanging containers of intravenously administered liquids in the conventional manner.

Another aspect of the horizontal member 280 is auxiliary IV attachment means 296 (FIG. 12) comprising elongate rods pivotally attached to the horizontal member 280 at a pivoting end 304. The auxiliary IV attachment means 296 further comprise an IV attachment end 308 containing at least one hook 312 from which a container of intravenously administered liquid can be hung. The horizontal member 280 contains a pair of slots recessed in its upper surface 300 for receiving the auxiliary IV attachment means 296 when not in use. When the auxiliary IV attachment means 296 are to be used, they are pivoted into a generally upright position and secured in place by fastening means. A cover 298 pivotally disposed on the horizontal member 280 can be used to cover the auxiliary IV attachment means 296 when they are received in the slots in the upper surface 300 of the horizontal member 280. These auxiliary attachment means 296 are useful for hanging containers of intravenously administered liquid when additional height is needed to facilitate gravity flow, such as when the apparatus 204 is used as a walker by an ambulatory patient.

Another illustrative embodiment of auxiliary IV attachment means 450 (FIGS. 11 and 13) comprises a generally horizontal IV attachment bar 454 disposed on two generally vertical support bars 458 and 462. Support bars 458 and 462 are slidably disposed in hollow channels in slidable supports 288*a* and 292*a*. The IV attachment bar 454 is an elongate member containing a plurality of hooks 466 spaced at intervals for hanging containers of intravenously administered liquids and the like. The IV attachment bar 454 and the horizontal member 280*a* of the IV stand means are adapted to nest together to conceal hooks 466 when the auxiliary IV attachment means 450 is lowered to its lowest position. The auxiliary IV attachment means 450 can be raised or lowered to a selected height by sliding the support bars 458 and 462 in the channels of the slidable supports 288*a* and 292*a*. A locking means is used to lock the IV attachment bar 454 at the selected height. This locking means can also be any locking means known in the art, such as ratchets, pins, cams, or the mechanism illustrated in FIG. 4.

The table means 216 is pivotally attached to the standard 212 by means of forward-projecting arms 316 on the slide members 272 and 276. The table means 216 preferably comprises a work surface 317 having a generally planar surface with a raised edge or rim to inhibit articles placed on the surface from sliding therefrom. The table means 216 can be locked into a generally horizontal position (FIG. 10) by locking means 320, an illustrative example of which will be described momentarily.

Figure 14:
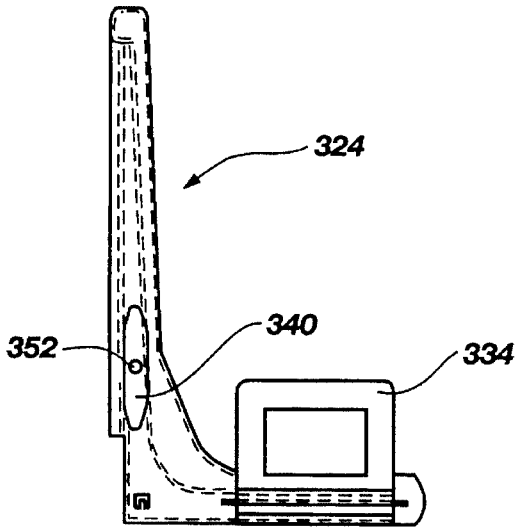
FIG. 14 shows a side elevational view of an illustrative embodiment of chair means in accordance with the apparatus of FIG. 7.

The table means 216 also comprises a reverse side 318 opposite the work surface comprising chair means 324 including a seat 328 and back 332. The chair means 324 is made available for use by unlocking the locking means 320, pivoting the table means 216 into a generally vertical position (FIG. 11), and returning the locking means 320 to a locked position. The slide members 272 and 276 should preferably be positioned at their lowest elevation, i.e. in contact with the base 208, for maximum stability. A patient can sit in the chair means 324 and place his or her feet on the foot rests 236 and 240. Arm rests are also preferably provided for comfort and safety of a patient seated in the chair means 324. The arm rests 333 (FIG. 12) can be pivotally disposed on the forwardly extending arms 316 of the slide members 272 and 276. In another embodiment, the arm rests 334 can be pivotally disposed on the seat 328 (FIGS. 11 and 14). If an intravenously administered liquid is being used, a container of the liquid can be hung from the IV stand means 214. Advantageously, a clip 336 for hanging a Foley catheter bag is disposed on the chair means to provide convenient access to such equipment if it is needed. Further, an oxygen bottle or similar equipment can be stored in the receptacle 234 in the base 208. Infusion pumps can be attached to the slidable supports 288 and 292 in the standard manner. Because of the small wheels on the apparatus 204 compared to the relatively large wheels of a conventional wheelchair, propulsion of the apparatus 204 as a wheeled chair should be limited to another person grasping the handle means 220 and pushing the apparatus 204 rather than the person sitting in the chair means 324 propelling the apparatus 204.

Figure 15:
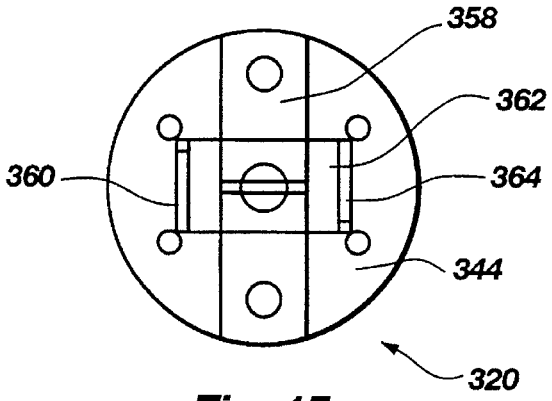
FIG. 15 shows a side elevational view of an illustrative embodiment of locking means for locking table means and chair means in a selected position in accordance with the apparatus of FIG. 7.
Figure 16:
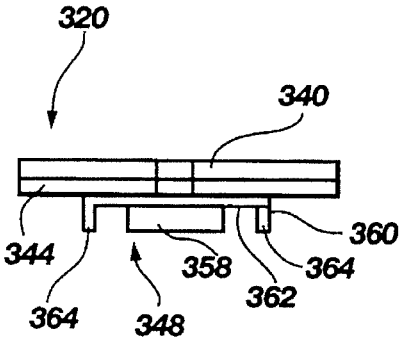
FIG. 16 shows a top view of the locking means of FIG. 15.
Figure 17:
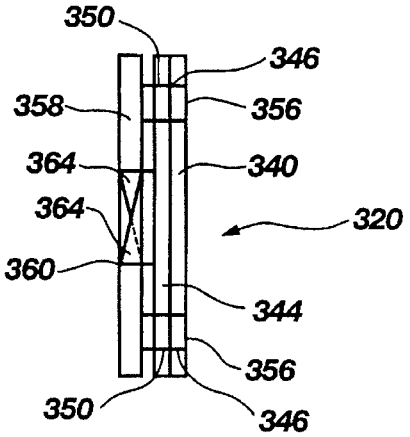
FIG. 17 shows a front elevational view of the locking means of FIG. 15.

An illustrative embodiment of locking means 320 is shown in FIGS. 15–17. The locking means 320 comprises a seat plate 340, a support arm plate 344, and a yoke pin assembly 348. The seat plate 340 is a generally planar member fixedly attached to the side of the chair means 324 (see FIG. 14), and contains several holes 346 through which pins can extend to prevent the chair means 324 from pivoting. When the pins are withdrawn, the chair means can pivot around pivot means 352. The support arm plate 344 is coupled to the forward-projecting arm 316 and can be integral therewith. The support arm plate 344 is also generally planar, contains at least 2 holes 350 through which pins may extend, and is disposed generally parallel to the seat plate 340. The holes 346 in the seat plate 340 and the holes 350 in the support arm plate 344 are alignable so that pins extending through the holes 350 in the support arm plate 344 can also extend through the holes 346 in the seat plate 340. The yoke pin assembly 348 comprises at least 2 pins 356 generally perpendicularly coupled to a yoke 358. Between the support arm plate 344 and the yoke 358 a wedge mechanism 360 comprising a generally planar rectangular plate section 362 with raised wedge sections 364 at either end is rotatably disposed. The pins 356 extend through the holes 350 in the seat arm plate 344 and can also extend through the holes 346 in the seat plate 340 or can be retracted to permit pivoting of the chair means 324 about the pivot means 352. The pins 356 are inserted to extend through the holes 346 in the seat plate 340 or retracted therefrom by rotating the wedge mechanism 360. Biasing means such as a spring is used to maintain the pins 356 in the holes 346 until the pins 356 are retracted. When the wedge mechanism is rotated, the wedge sections 364 are inserted between the support arm plate 344 and the yoke 358, separating them and thus retracting the pins 356 from the holes 346 in the seat plate 340 and permitting the table means 216 and chair means 324 to pivot. Thus, the positioning of the table means 216 and chair means 324 is accomplished by turning the wedge mechanism 360 to retract the pins 356 from the holes 346 in the seat plate 340, pivoting the table means 216 and chair means 324 about the pivot means 352 to a selected position, aligning the holes 350 in the support arm plate 344 with holes 346 in the seat plate 340 at the selected position, and turning the wedge mechanism 360 to insert the pins 356 into the holes 346 in the seat plate 340 to thus prevent pivoting of the table means 216 and chair means 324.

Figure 12:
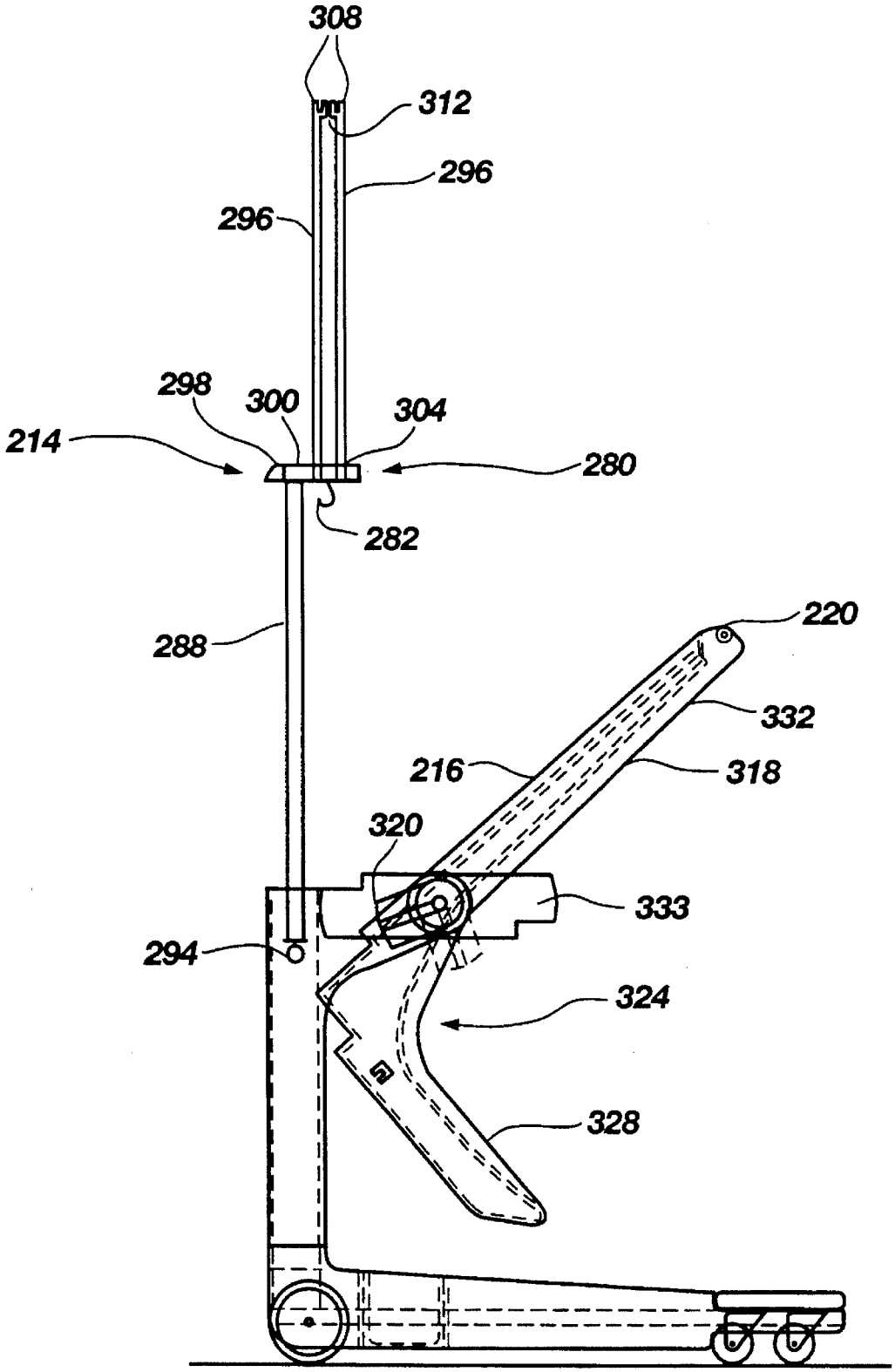
FIG. 12 shows a side elevational view of the apparatus of FIG. 7 with the table means and chair means in an intermediate position and with one embodiment of auxiliary IV support means in an extended position.
Figure 13:
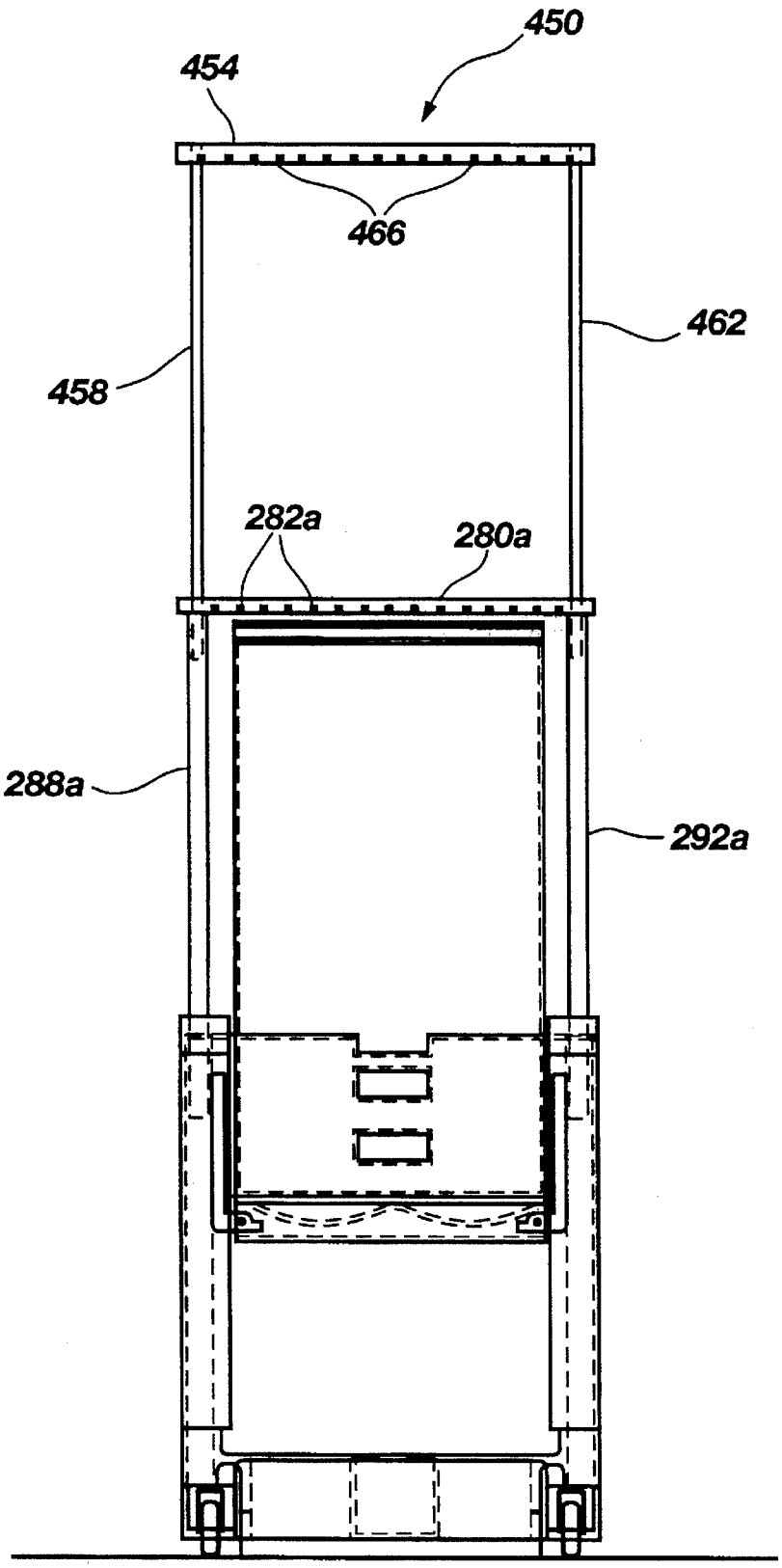
FIG. 13 shows a front elevational view of the apparatus of FIG. 11.

The table means 216 can also be positioned in an intermediate position, i.e. at about a 45° angle, when the apparatus 204 is used as a walker (FIG. 12). The table means 216 is moved to this position by unlocking the locking means 320, pivoting the table means 216 to the selected angle, and relocking the locking means 320. The patient then stands between the side members 224 and 228 of the base 208, with the foot rests 236 and 240 retracted, grasps the handle means 220, and walks, leaning on the apparatus 204 as needed for support.

The above describes two complete embodiments of the invention including the best mode presently known for making and using the apparatus. However, equivalent means or structure are not excluded and the invention is to be limited only by the scope of the appended claims and functional equivalents thereof.

I claim:

1. Apparatus combining an overbed table, an IV stand, and a walker comprising a wheeled base, having a rear portion, comprising generally horizontal elongate side members having front and back ends interconnected by a back cross member adjacent said back ends, said elongate side members extending forwardly from said back cross member so as to project beneath a bed frame, said side members containing wheels at the back and front ends for providing maneuverability and stability;

a generally vertical standard at the rear portion of said base comprising generally parallel, spaced apart, upwardly extending hollow support members disposed on said base;

a table means vertically adjustable to at least one height disposed on said support members by attachment means and overlying said base for providing a generally horizontal work surface adapted to overlie said bed frame when said wheeled base projects therebeneath;

means for adjusting the height of said table means;

handle means disposed on said standard for gripping said apparatus; and vertically adjustable IV stand means disposed on said support members of said standard for supporting at least one intravenously administered liquid, wherein said IV stand means comprises generally horizontally disposed upper and lower elongate members, said upper member disposed on a pair of generally vertical members slidably disposed in said hollow support members, wherein said upper member has disposed thereon a plurality of spaced apart IV attachment means for supporting containers of intravenously administered liquid and said lower member is adapted for receiving said upper member for concealing said IV attachment means.

2. The apparatus of claim 1 wherein said table means comprises a generally planar work surface having at least one upwardly extending edge and said attachment means comprises a bracket having a downwardly extending lip and a generally horizontal table support surface joined by a C-shaped member that encloses a hollow adapted to receive said upwardly extending edge of the table means.

3. The apparatus of claim 2 wherein said upwardly extending edge circumscribes said work surface.

4. The apparatus of claim 2 further comprising means for attaching said apparatus to the bed frame comprising a downwardly extending tab disposed on said bracket of said attachment means for fitting over the bed frame.

5. The apparatus of claim 1 wherein said slidably disposed vertical members comprise means for attaching fluid delivery devices.

6. The apparatus of claim 1 further comprising a chair disposed on said standard.

7. The apparatus of claim 6 wherein said table means further comprises a side opposite said work surface, pivoting means coupled to said standard for pivoting said table means, and means for locking said table means to selectively prevent said table means from pivoting, and wherein said chair is joined to said side opposite said work surface such that when said table means is disposed in a generally horizontal orientation said chair is unavailable for seating an individual and when said table means is disposed in a generally vertical orientation said chair is disposed for seating an individual.

8. The apparatus of claim 7 further comprising foot rest means pivotally disposed on said base for resting a foot and arm rest means pivotally disposed on said chair for resting an arm.

9. The apparatus of claim 1 wherein said means for adjusting the height of said table means comprises securing means having a generally horizontal elongate grip bar disposed on said attachment means, two generally vertical connector bars pivotally disposed on said grip bar, and a stop link pivotally disposed on each said connector bars, wherein said hollow support members comprise openings spaced apart at intervals along a vertical length thereof and each stop link contains a projecting portion adapted to be received in said openings.

10. Apparatus combining an overbed table, an IV stand, a walker, and a wheeled chair comprising a wheeled base, having a rear portion, comprising generally horizontal elongate side members having front and back ends interconnected by a back cross member adjacent said back ends, said elongate side members extending forwardly from said back cross member so as to project beneath a bed frame, said side members containing wheels at the back and front ends for providing maneuverability and stability;

a generally vertical standard at the rear portion of said base comprising generally parallel, spaced apart, upwardly extending hollow support members disposed on said base;

a table means vertically adjustable to at least one height disposed on said support members by attachment means and overlying said base for providing a generally horizontal work surface adapted to overlie said bed frame when said wheeled base projects therebeneath;

means for adjusting the height of said table means;

handle means disposed on said table means for gripping said apparatus;

vertically adjustable IV stand means disposed on said support members of said standard for supporting at least one intravenously administered liquid; and a chair disposed on said standard;

wherein said table means is pivotally disposed on said support members and includes a side opposite said work surface, and said chair is joined to said opposite side such that when said table means is disposed in a generally horizontal orientation said chair is unavailable for seating an individual and when said table means is disposed in a generally vertical orientation said chair is disposed for seating an individual.

11. The apparatus of claim 10 further comprising locking means for locking said table means and said chair in a selected orientation.

12. The apparatus of claim 11 wherein said work surface comprises a generally planar table.

13. The apparatus of claim 10 wherein said work surface comprises a tray having a generally planar surface circumscribed by raised edges of said surface.

14. The apparatus of claim 10 wherein said IV stand means comprises a generally horizontally disposed lower elongate member, said lower member disposed on a pair of generally vertical first slide members slidably disposed in said hollow support members, wherein said lower member has disposed thereon a plurality of spaced apart IV attachment means for supporting containers of intravenously administered liquid.

15. The apparatus of claim 14 wherein said first slide members are hollow and said IV stand means further comprises a generally horizontally disposed upper elongate member disposed on a pair of generally vertical second slide members slidably disposed in said hollow first slide members, wherein said upper member has disposed thereon a plurality of spaced apart IV attachment means for supporting containers of intravenously administered liquid.

16. The apparatus of claim 15 wherein said upper member and said lower member are adapted for receiving each other for concealing said IV attachment means disposed on said upper member.

17. The apparatus of claim 15 wherein said first and second slide members comprise means for attaching fluid delivery devices.

18. The apparatus of claim 10 further comprising foot rest means pivotally disposed on said base for resting a foot and an arm rest means pivotally disposed on said chair for resting an arm.

19. The apparatus of claim 10 wherein said back cross member of said wheeled base further comprises a means for receiving a fluid container.

* * * * *